US011072914B2

(12) United States Patent
Ye et al.

(10) Patent No.: US 11,072,914 B2
(45) Date of Patent: Jul. 27, 2021

(54) EXTRACTABLE FAUCET

(71) Applicants: XIAMEN LOTA INTERNATIONAL CO., LTD., Xiamen (CN); LOTA XIAMEN INDUSTRY CO., LTD., Xiamen (CN)

(72) Inventors: Liming Ye, Xiamen (CN); Jianping Zhou, Xiamen (CN); Shuanglin Bai, Xiamen (CN)

(73) Assignees: XIAMEN LOTA INTERNATIONAL CO., LTD., Xiamen (CN); LOTA XIAMEN INDUSTRY CO., LTD., Xiamen (CN)

( * ) Notice: Subject to any disclaimer, the term of this patent is extended or adjusted under 35 U.S.C. 154(b) by 181 days.

(21) Appl. No.: 16/401,637

(22) Filed: May 2, 2019

(65) Prior Publication Data

US 2020/0032495 A1 Jan. 30, 2020

(30) Foreign Application Priority Data

Jul. 30, 2018 (CN) ..... 201810852239.X

(51) Int. Cl.
*E03C 1/04* (2006.01)

(52) U.S. Cl.
CPC ..... *E03C 1/0404* (2013.01); *E03C 1/04* (2013.01); *E03C 2001/0415* (2013.01); *E03C 2201/30* (2013.01); *E03C 2201/40* (2013.01); *Y10T 137/87161* (2015.04); *Y10T 137/9464* (2015.04)

(58) Field of Classification Search
CPC ..... E03C 1/0404; E03C 1/0411; E03C 2001/0415; E03C 2201/40
USPC ..... 248/69
See application file for complete search history.

(56) References Cited

U.S. PATENT DOCUMENTS 4,889,168 A * 12/1989 Kerzich ..... F16L 35/00 138/103
8,185,984 B2 * 5/2012 Meehan ..... E03C 1/0401 4/695
2002/0092574 A1 * 7/2002 Aldred ..... E03C 1/0404 137/801
2003/0102256 A1 * 6/2003 Takagi ..... C02F 1/288 210/101

(Continued)

FOREIGN PATENT DOCUMENTS

DE 2629795 A1 * 1/1978 ..... F16L 27/0816
DE 102014109822 A1 * 1/2016 ..... E03C 1/0411

(Continued)

*Primary Examiner* — Kenneth Rinehart
*Assistant Examiner* — Richard K. Durden
(74) *Attorney, Agent, or Firm* — Zhong Law, LLC

(57) ABSTRACT

Disclosed herein is a faucet comprising a faucet housing configured as a tubular member with a cavity and a faucet body that includes a head and a conduit. A water inlet end of the head is connected to the conduit. A first support is received in the cavity and located in a water outlet end of the faucet housing. The head is freely received in the first support and a purified water pipe is embedded detachably into the first support. A mounting seat is configured to function as a water distributor and is detachably engaged with the faucet housing. A valve cartridge is received in the mounting seat and configured to control the shut off of the conduit and the purified water pipe, and to separate the flow path of the tap-water and the flow path the purified water.

9 Claims, 7 Drawing Sheets

(56) References Cited

U.S. PATENT DOCUMENTS

2003/0146307 A1* 8/2003 Herring ..... E03C 1/0404 239/569
2007/0235091 A1* 10/2007 Granot ..... F16K 11/0655 137/597
2008/0099091 A1* 5/2008 Benstead ..... F16K 31/58 137/801
2009/0211654 A1* 8/2009 Nobili ..... F16L 39/02 137/597
2009/0276954 A1* 11/2009 Davidson ..... E03C 1/0401 4/695
2012/0018020 A1* 1/2012 Moore ..... E03C 1/0403 137/798
2012/0067437 A1* 3/2012 Xia ..... E03C 1/0404 137/317
2012/0137428 A1* 6/2012 Wang ..... E03C 1/0404 4/695
2012/0312401 A1* 12/2012 Gioira ..... E03C 1/04 137/603
2014/0261750 A1* 9/2014 Rosko ..... F16K 21/00 137/78.1
2015/0000033 A1* 1/2015 Wagner ..... E03C 1/04 4/678
2016/0305101 A1* 10/2016 Liu ..... F16K 11/0787
2017/0152649 A1* 6/2017 Chang ..... E03C 1/08
2018/0244541 A1* 8/2018 Pirutin ..... B01D 39/06
2019/0085538 A1* 3/2019 Chang ..... F16K 5/08
2019/0186111 A1* 6/2019 Zeng ..... E03C 1/04

FOREIGN PATENT DOCUMENTS

EP 2770122 A2 * 8/2014 ..... E03C 1/108
WO WO-2004104306 A1 * 12/2004 ..... E03C 1/0404
WO WO-2017123087 A1 * 7/2017 ..... E03C 1/0405
WO WO-2019010078 A1 * 1/2019 ..... E03C 1/0404

* cited by examiner

EXTRACTABLE FAUCET

CROSS-REFERENCE TO RELATED APPLICATIONS

This application claims priority to Chinese application No. CN 201810852239.X, filed Jul. 30, 2018, which is hereby incorporated by reference as though fully set forth herein.

TECHNICAL FIELD

The present disclosure relates to the technical field of fluid switching, and in particular, to an extractable faucet integrated with a purified water flow path.

BACKGROUND

The extractable faucet is a well-known type of faucet used in kitchens. It is popular to a wide range of users because it is easy to remove and efficient and convenient to use. The existing extractable faucet is usually used for cleaning the kitchen utensils (for example table ware, cups, etc.) and food (for instance fruits, vegetables, etc.). The cleaning usage makes the faucet mostly supplied with the tap-water rather than directly supplied with the drinking water.

Tap-water is commonly purified and disinfected by water treatment plants to conform with national drinking water standards for household and production use. The disinfection of tap-water is realized mostly through a chlorination process with the primary purpose to prevent disease transmission via water. Although existing tap-water disinfection technology and apparatus produce relatively satisfactory results, people find that there are still deficiencies in employing the chlorination process to disinfect tap-water based on theoretical analyses and studies. Furthermore, the water supplied to a consumer via water-supply pipelines and pumps may not always meet the national drinking water standards, so the consumer may still need to boil the supplied water before consumption.

As people in modern time have a higher standard for quality of life, e.g., in terms of drinking water, people usually prefer purified water, which is more likely to conform with the national drinking water standard. Nevertheless, the existing majority of extractable faucets are unable to provide simultaneously domestic water for different usages (such as cleaning, drinking, etc.) depending on user's requirements due to its structure limit. Those existing faucets which can supply purified water and tap-water simultaneously have deficiencies such as that the purified water and the tap-water are easily mixed, causing the purified water being polluted. To obtain secure direct drinking water, user needs to provide additional faucet for direct drinking water and makes the control of the direct drinking water and that of the purified water independent from each other or alternatively, provides another device for storing direct drinking water, so as to satisfy user's drinkable requirement for the direct drinking water.

Based thereon, this disclosure provides an extractable faucet having novel structure and integrated simultaneously with purified water line.

SUMMARY OF THE DISCLOSURE

Therefore, it is an object of the present disclosure to provide an extractable faucet integrated with purified water supply function, thereby overcoming the disadvantages of the existing technology.

To accomplish above object, this disclosure provides an extractable faucet, comprising: a faucet housing which is configured as a tubular member with a cavity; a faucet body which comprises an extractable head and an extractable conduit, and a water inlet end of the extractable head is connected to the extractable conduit; a first support which is received in the cavity and located in an water outlet end of the faucet housing, the extractable head is freely received in the first support, and a purified water pipe is embedded detachably into the first support in a circumferential direction of the first support, wherein the purified water pipe and the extractable conduit run along the length of the faucet housing; a mounting seat which is configured to function as a water distributor and detachably engaged with the faucet housing; a valve cartridge which is received in the mounting seat, and is used for controlling the shut off for the extractable conduit and the purified water pipe, and separating the flow path of the tap-water and that of the purified water, wherein the tap-water flows through the extractable conduit.

Preferably, the extractable faucet further comprises a second support which is secured into the cavity, the second support comprises a base part, a holding part and a transition part, wherein the base part is configured in the form of cylinder, and the transition part extends from the base part towards the water outlet end of the faucet housing and bends to conform to the curvature of the faucet housing, and the holding part is disposed on the transition part and spaced apart from the base part, wherein the extractable conduit and the purified water pipe are provided within the second support and separated by the holding part.

Preferably, the holding part comprises a first holding portion and a second holding portion, and the second holding portion is located in a space delimited by the first holding portion and on its circumferential surface is connected to the first holding portion on a circumferential surface of the second holding portion, wherein the extractable conduit is disposed in the first holding portion and the purified water pipe is disposed in the second holding portion.

Preferably, the second support is disposed within the cavity of the faucet housing, and an engagement portion is provided on an outer circumferential surface of the base part, and the faucet housing is provided with an engagement hole on its radial direction, wherein the second support is secured to the cavity by the engagement between the engagement portion and the engagement hole.

Preferably, the faucet housing is rotatable with respect to the mounting seat, and the second support can be moved together with the faucet housing.

Preferably, the extractable faucet further comprises rotation detent part, which is configured to comprise a guide slot and a protrusion mated with each other, and they are disposed at an engagement where the faucet housing is engaged with the mounting seat, wherein the guide slot can allow the sliding of the protrusion and is configured to have a sector rotation region, whereas the faucet housing at most can rotate 180° with respect to the mounting seat with the protrusion rotating in the sector rotation region.

Preferably, the extractable faucet further comprises a wear-resistant structure disposed in a region of the engagement where the faucet housing is engaged with the mounting seat so that the extractable faucet may be free of wears when it rotates in relative to the mounting seat.

Preferably, the wear resistant structure comprise a wear sleeve and a wear washer, the wear sleeve is sleeved on one end of the faucet housing which is oriented towards the mounting seat, and the wear sleeve has a locating portion, the mounting seat is provided with a locating hole on its circumferential surface, wherein the locating portion engages to the locating hole in order to locate the wear sleeve, and the wear washer is provided on the faucet housing and located between the faucet housing and the mounting seat in its axial.

Preferably, the extractable faucet further comprises a tube assembly which is received in a lateral opening of the mounting seat and operated with the valve cartridge, the tube assembly includes a base member, a first set of pipe fitting for the tap-water and a second set of pipe fitting for purified water, wherein the first set of pipe fitting involves a cold water pipe, a hot water pipe and a mixing water pipe, the second set of pipe fitting involves an inlet tube and an outlet tube, and the first set of pipe fitting and the second set of pipe fitting are secured on the base member.

Preferably, the wear-resistant sleeve is configured to a bellows-shape piece with an opening, and the locating portion is configured to extend outwards in the radial direction of the wear-resistant sleeve for engaging to the locating hole of the mounting seat.

BRIEF DESCRIPTION OF DRAWINGS

Hereinafter, the embodiments of the present disclosure will be described in detail in combination with drawings, wherein.

DETAILED DESCRIPTION

Figure 1:
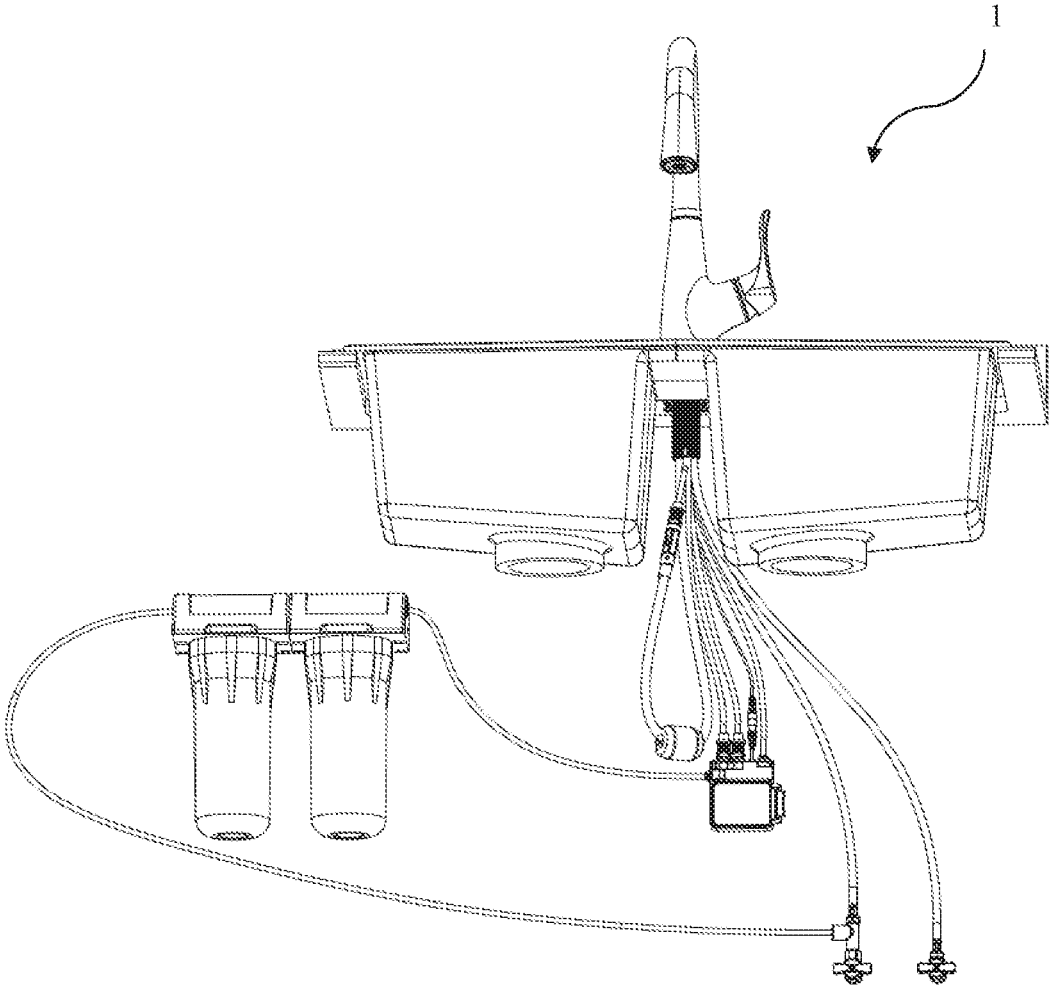
FIG. 1 is a perspective view of the extractable faucet according to an embodiment of the disclosure.

Now the schematic solutions of the extractable faucet disclosed by the present disclosure will be described in detail. Although some drawings are provided to illustrate some embodiments of the present disclosure, these drawings may not necessarily be depicted in scale, and some features may be enlarged, removed or cut off in part to show and explain the disclosure of the present disclosure better. The positions of some elements in the drawings may be adjusted as desired without influencing the technical effect. The phrase "in the drawings" or the like presented in the description may not refer to all the drawings or examples.

Some orientation terms, e.g. "inner", "outer", "upper", "lower" and other orientation terms, as used hereinafter for describe the drawings will be understood as having their normal meanings and indicating those directions as involved when the drawings are viewed normally. Basically, the orientation terms as stated in the present specification will be interpreted according to the routine directions as understood by the skilled person in the art, unless otherwise specified.

The terms "first", "the first", "second", "the second" and the like as used in the disclosure do not represent any order, amount or importance in this disclosure, but rather are used to differentiate one element from other elements.

As shown in FIGS. 1 to 10, the disclosure provides an extractable faucet 1, which comprises a faucet housing 10, a faucet body 11, a first support 12, a mounting seat 13 and a valve cartridge 14. Specifically, with reference to FIG. 3, the faucet housing 10 is configured as a tubular member with a cavity. The faucet body 11 may include an extractable head 110 and an extractable conduit 111, and an inlet end of the extractable head 110 is connected to the extractable conduit. The first support 12 is accommodated in the cavity of the faucet housing 10 and located at an outlet end of the faucet housing 10. Wherein, the extractable head 110 is mounted detachably into the first support 12. An accommodation portion is provided on the circumferential surface of the first support 12 for accommodating a purified water pipe 112. In particular, the accommodation portion can be provided as a recess and the purified water pipe 112 is embedded in the recess portion. Both the extractable conduit 111 and the purified water pipe 112 extend along the length of the faucet housing 10 and bend to conform to a curvature of the faucet housing 10. The mounting seat 13 is used for installing and engaging the faucet housing 10 and is configured to function as a water distributor and is connected with the faucet housing 10 in a detachable form. The valve cartridge 14 is mounted within the mounting seat 13 and the valve cartridge 14 can control the shutoff of the extractable conduit 111 as well as that of the purified water pipe 112, and a flow path of the purified water is shut off when the flow path of the tap-water is switched on and vise versa, thereby separating the flow path of purified water from the flow path of the tap-water in order to avoid polluting the purified water in the case of possibility mixture of the purified water and the tap-water.

In order to better support the extractable conduit 111 and the purified water pipe 112 and prevent from a twisting of them in the extraction and reset process. In an embodiment, referring to FIGS. 3-4, the extractable faucet 1 further includes a second support 15 which is mounted fixedly within the cavity of the faucet housing 10.

Figure 3:
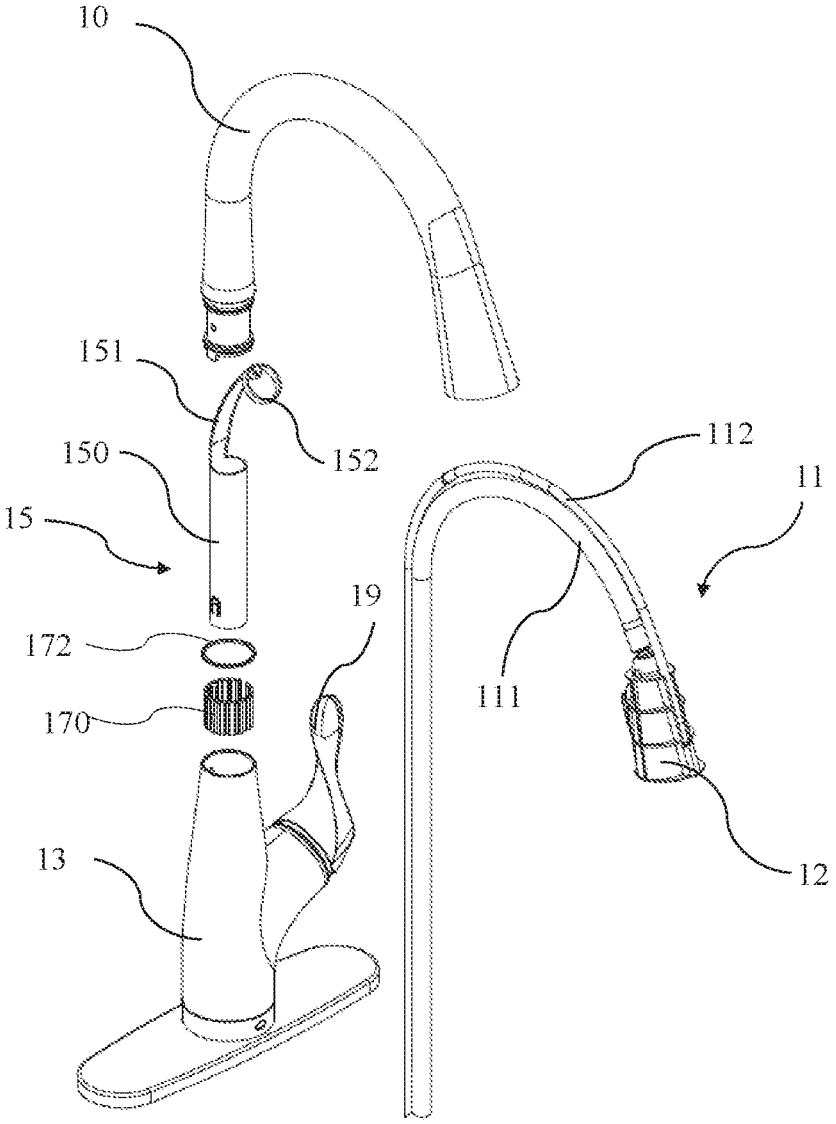
FIG. 3 is an exploded schematic view of the extractable faucet according to an embodiment of the disclosure.
Figure 4:
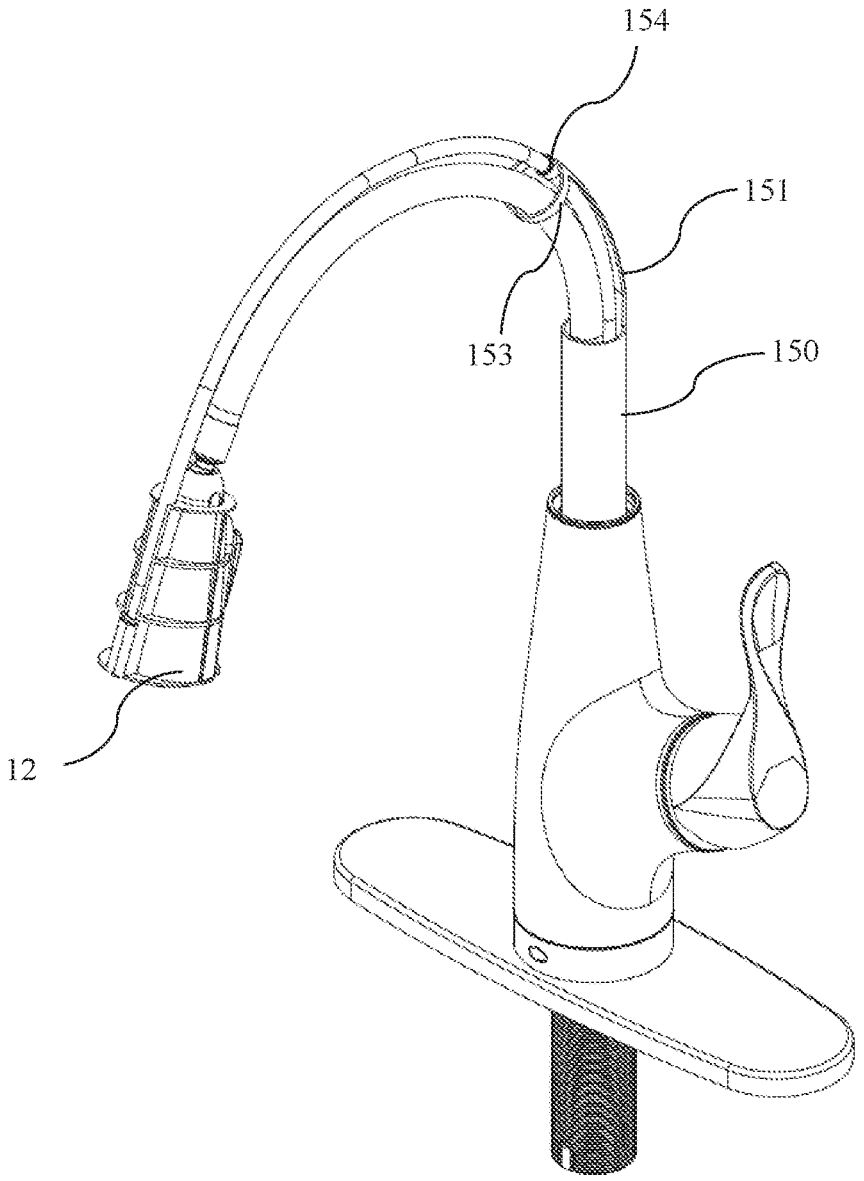
FIG. 4 is a partial assemble schematic view of the extractable faucet according to an embodiment of the disclosure.

In a particular embodiment, as shown in FIGS. 3-4, the second support 15 comprises a base part 150, a holding part 152 and a transition part 151. Wherein, the base part 150 is configured in the form of tubular to allow the extractable conduit 111 and the purified water pipe to pass through it, and the transition part 151 extends from the base part 150 to the outlet end of the faucet housing 10 and bends to conform to the radian of the faucet housing 10 in order to move within the cavity of the faucet housing 10. The holding part 152 is disposed on the transition part 151, and the transition part 151 extends a certain distance so as to separate the base part 150 from holding part 152. The extractable conduit 111 and the purified water pipe 112 respectively go through the second support 15 and are separated from each other at the holding part 152. In a preferred embodiment, the holding part 152 is configured to include a first holding portion 153 and a second holding portion 154, wherein the second holding portion 154 is located within a space delimited by the first holding portion 153, and the first holding portion 153 is connected to the circumferential surface of the second holding portion 154. The extractable conduit 111 is disposed within the first holding portion 153, and the purified water pipe 112 is disposed within the second holding portion 154. In particular, an engagement portion is provided on outer circumferential surface of the base portion of the second support 15, such as the engagement portion may be configured as a protrusion. There is an engagement hole provided in the radial direction of the faucet housing 10, and the second support 15 is fixed in the cavity of the faucet housing 10 by the engagement between the engagement portion and the engagement hole. Optionally, the first holding portion 153 is configured to be an annular member, and the annular member is connected to one end of the transition part 151 which is apart from the base part 150, while the second holding portion 154 is also configured as an annular member, and the second holding portion 154 may be inscribed with the first holding portion 153 and connected fixedly to it at the point of tangency. When the second support 15 is mounted within the cavity of the faucet housing 10, there is a snap provided on the lower portion (adjacent to an end portion) of the base part 150 so as to achieve a steady installation and location of the second support 15. The snap can be configured as a projection, and there is a corresponding locating hole disposed on the lower portion of the faucet housing 10. The second support 15 is relatively steadily secured in the faucet housing 10 by means of the engagement between the snap and the locating hole upon the second support 15 is located in the cavity. The extractable conduit 111 goes through the first holding portion 153, and the purified water pipe 112 goes through the second holding portion 154. Due to the limitation as provided by a curved radian of the transition part 151, the purified water pipe 112 is defined by the second holding portion 154 to rest against the inner wall of the faucet housing 10, the arrangement of the above-mentioned holding part 152 makes it impossible for the purified water pipe 112 to affect the extraction and reset of the extractable conduit 111.

Figure 5:
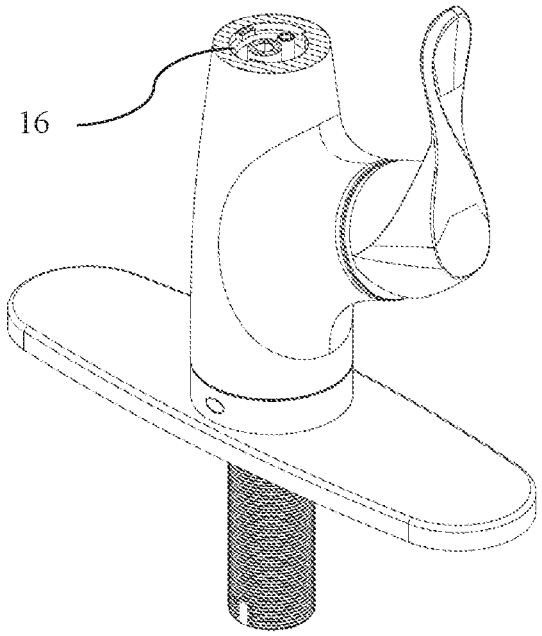
FIG. 5 is a partial sectional view of the rotary holding portion of faucet housing and the mounting seat according to an embodiment of the disclosure.
Figure 6:
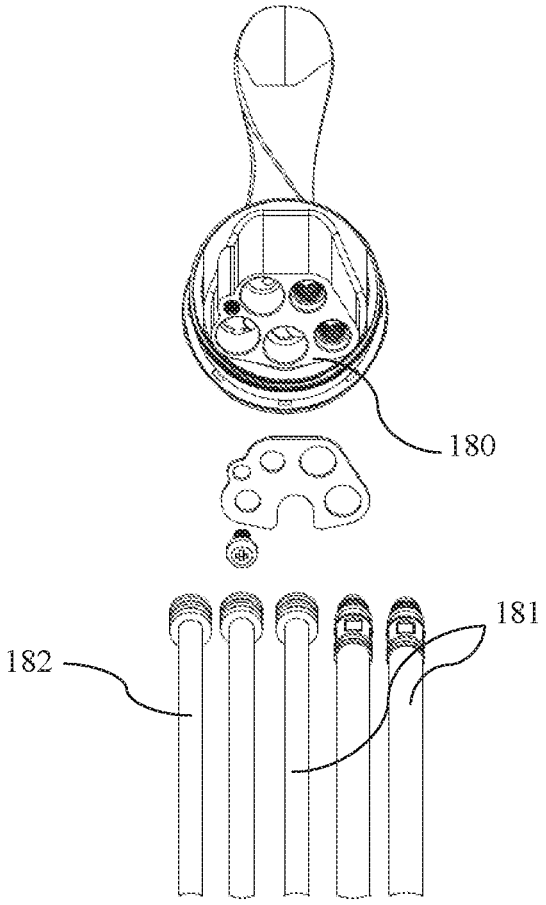
FIG. 6 is an exploded schematic view of the tube assembly according to an embodiment of the disclosure.
Figure 7:
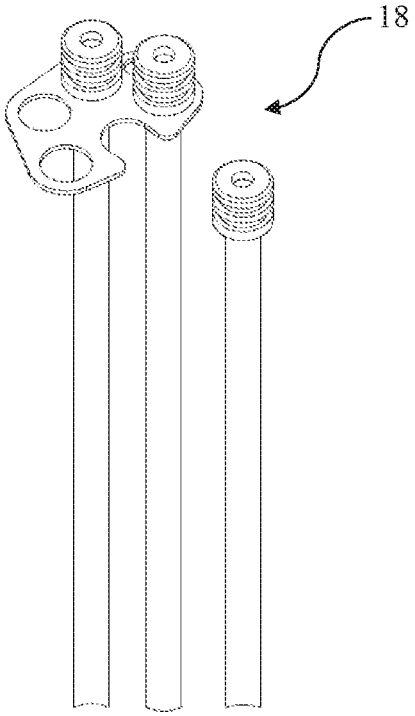
FIG. 7 is a partial assemble schematic view of the tube assembly according to an embodiment of the disclosure.
Figure 8:
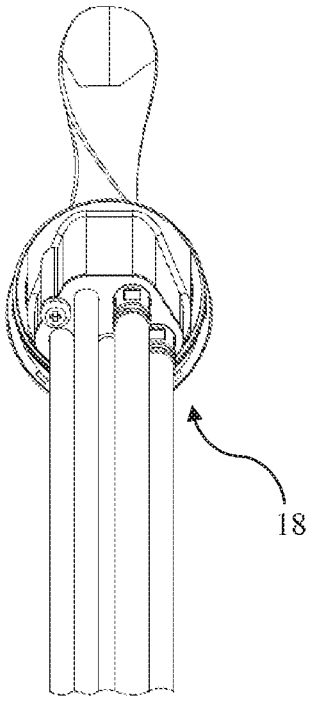
FIG. 8 is an assemble schematic view of the tube assembly according to the disclosure.

To facilitate the usage of the extractable faucet 1 and make it suitable for multiple tanks, the faucet housing 10 of the extractable faucet 1 of present disclosure can rotate with respect to the mounting seat 13, and the second support 15 located inside the faucet housing 10 can synchronously move together with the faucet housing 10. In detail, the extractable faucet 1 can also include a rotation detent part 16 so as to confine the rotation range of the faucet housing 10 relative to the mounting seat 13. As shown in FIG. 5, the rotation detent part 16 is configured to be provided with a guide slot and a protrusion which are matched up each other when the faucet 10 and the mounting seat 13 is engagement, i.e. the guide slot and the protrusion are exchangeable on the faucet housing 10 and mounting seat 13. In an embodiment, the guide slot is disposed on the mounting seat 13, and the guide slot is specifically formed on the inner circumferential surface of the mounting seat 13, which is formed by means of making the guide slot concave towards the radial direction of the mounting seat 13 and is orientated to the mounting side of the faucet housing 10. The protrusion is provided on the faucet housing 10 and extends in the length of the faucet housing 10. The protrusion can be inserted into the guide slot and move along the passage defined by the guide slot as the faucet housing 10 is mounted on the mounting seat 13. In this embodiment, the guide slot is configured in form of sector, the angle of which is configured to be no more than 180 degrees. In this angle range, the extractable faucet 1 can implement the switching on-off between the cold water, the hot water, mixed water of the tap-water and the purified water. Naturally, those skilled in the art should appreciate that the rotation angle of the faucet housing 10 is not only limited to 180 degrees, other definitions regarding to the angle of the sector are not departing from the spirit of the disclosure, based on which, any modifications and improvements are encompassed within the range of this disclosure.

Figure 9:
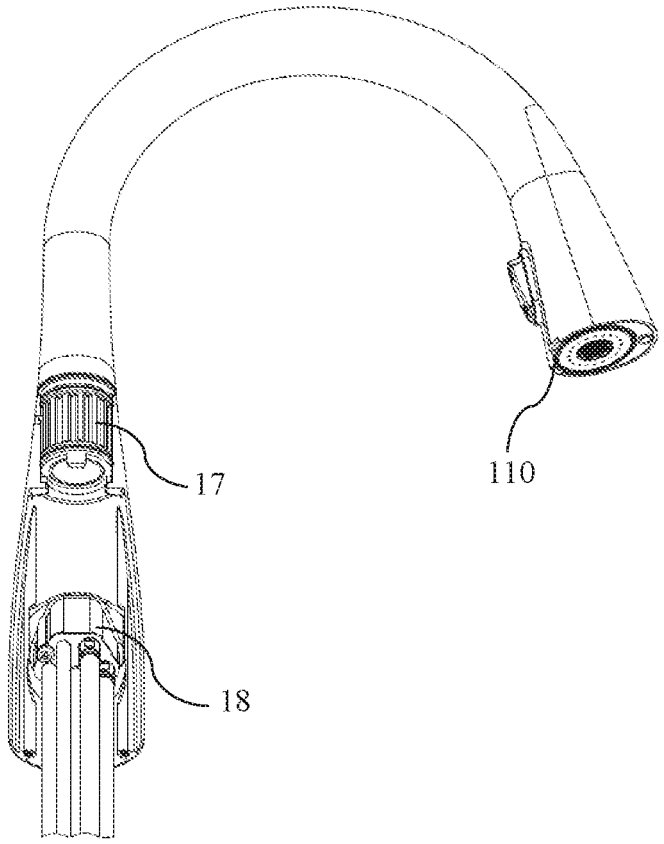
FIG. 9 is a partial perspective schematic view of the extractable faucet according to an embodiment of the disclosure.

For the purpose of avoiding excessive wear of the extractable faucet 1 during the reduplicative rotation operation, in a preferred embodiment, the extractable faucet 1 further comprises a wear-resistant structure 17 and this wear-resistant structure 17 is arranged in an engagement region of the faucet housing 10 and the mounting seat 13, as shown in FIGS. 3 and 9. The wear-resistant structure 17 includes, in particular, a wear sleeve 170 and a wear washer 172. When the faucet housing 10 is seated partially in the mounting seat 13 and after the guide slot is matched with the protrusion, the mounting seat 13 and the faucet housing 10 are partially overlapped in an certain area in the axial direction, in which the wear-resistant sleeve 170 is sleeved on the end of the faucet housing 10 orienting to the mounting seat 13,—namely, the mounted wear-resistant sleeve 170 is located in the overlapped area between the mounting seat 13 and the faucet housing 10. The wear-resistant sleeve 170 is provided with a locating portion, which is located in the upper end of the wear-resistant sleeve 170 in the axial direction. The wear-resistant sleeve 170 is configured as a bellows-shaped member with an opening, and the locating portion is configured to extend outwards in the radial direction of the wear-resistant sleeve 170 for engaging to the locating hole of the mounting seat 13. Because the locating hole is provided at the circumferential surface of the mounting seat 13, and the locating portion is optionally an snap projecting from the circumferential surface of the wear-resistant sleeve 170, the snap can be snapped into the locating hole, causing a precise location the wear-resistant sleeve 170 while it is mounted in the mounting seat 13. When rotating the faucet housing 10 with respect to the mounting seat 13, the wear-resistant sleeve 170 (specially the wear-resistant sleeve 170 with the bellows-shaped structure) is able to effectively help prevent from the excessive wears of the faucet housing 10 and the mounting seat 13, thereby prolonging their service life. Moreover, the wear-resistant washer 172 can be disposed at an opposite end surfaces of the mounting seat 13 and the faucet housing 10. In such cases, the faucet housing 10 can directly contact with the wear-resistant washer 172 without contacting with the mounting seat 13 so as to be free of wears during the rotation of the faucet housing 10. In addition, the wear-resistant structure 17 may further include an elastic rubber ring, and there is an annular metal ring embedded at an end of the faucet housing 10 orienting towards the mounting seat 13. An upper end and a lower end of the annular metal ring are provided with a groove respectively, and the elastic rubber ring can be received within the groove. In this way, the grooves at the upper end and the lower end can also function to define the position of the annular metal ring, thus preventing its movement in the axial direction. During the rotation of the faucet housing 10 with respect to the mounting seat 13, a gap is formed by the rubber ring separating the annular metal ring from the mounting seat 13 so that the contact between the annular metal ring and the mounting seat 13 due to the elasticity of the elastic rubber ring is prevented to the greatest extent.

Furthermore, with reference to the FIGS. 6 to 10, the extractable faucet 1 can also include a tube assembly 18 which is received in a lateral opening of the mounting seat 13 and operates in cooperation with the valve cartridge 14 which is also received in the lateral opening of the mounting seat 13. The tube assembly 18 includes a base member 180, a first set of pipe fitting 181 for the tap-water and a second set of pipe fitting 182 for purified water. Particularly, the first set of pipe fitting 181 can include a cold water pipe, a hot water pipe and a mixed water pipe, whereas, the second set of pipe fitting 182 can include an inlet tube and an outlet tube, wherein the first set of pipe fitting 181 and the second set of pipe fitting 182 are secured on the base member 180. To facilitate mounting, two pipes among the inlet tube of the purified water, the outlet tube of the purified water, the mixed water pipe of the tap-water are integrally coupled by molded plate, and another pipe can be detachably coupled to the molded plate (in accordance with a particular embodiment of the disclosure, there are five apertures provided in the molded plate, through which two set of pipe fittings pass, wherein four apertures are constructed as a closed aperture, one is constructed as an open aperture, two pipes integrally coupled with the molded plate are located in the closed apertures, and the other detachable pipe is located in the open aperture), and the other two pipes (a hot water pipe and a cold water pipe, both with threads at the connection ends) may go through the molded plate and are screwed on to base member 180, the molded plate is fixed by means of the thread connection of the cold water pipe, the hot water pipe and the base member. In order to further enhance the fixation, several threaded components (such as screws) are also provided and there are several preset apertures on the molded plate for passing the threaded components. During the installation, the threaded components are forced to pass through the molded plate and connected to the base member 180 so as to the other three pipes connected to the molded plate are secured to base member 180, thereby realizing the fixation between the two set of pipe fittings and the base member 180. In this embodiment, the two set of pipe fittings and base member 180 of the tube assembly 18 can be initially assembled outside of mounting seat 13, and then the assembled tube assembly 18 is inserted into the mounting seat 13 from the bottom of the three-way structural mounting seat 13, and the base member 180 may be mounted and secured to the lateral opening of the mounting seat 13. Thus the valve cartridge 14 is pressed against by a cover so as to cooperate with the base member 180 for controlling the shut off of the fluid.

A valve cartridge which is used for shutting off the tap-water and the purified water of the above described extractable faucet can include a valve housing, a valve seat, a valve stem, a movable valve plate, a static valve plate and a rotary base. Wherein, the rotary base is located within the valve housing, below the rotary base is stacked with a linkage component, the movable valve plate and the static valve plate in sequence. The valve housing engages with the valve seat. The valve stem projects from the rotary base out of the valve housing and is connected controllably to the rotary base. The linkage component may be provided below the rotary base and can be driven by the valve stem, and then the valve plates are associatively driven. Wherein, the valve plates includes a movable valve plate and a static valve plate, the movable valve plate includes a mixing chamber and a guiding groove, and the guiding groove can be communicated with an opening for introducing the purified water, the static valve plate includes a first introduction hole and a second introduction hole for introducing the cold water and the hot water respectively, a tap-water outlet hole for outputting the mixing water and a purified water outlet hole for outputting the purified water. The valve stem is rotatable with respect to the rotary base, while a connection is associatively driven to further drive the translation and rotation of the movable valve plate relative to the static valve plate. During the movement of the movable valve plate relative to the static valve plate, the tap-water is switched on as the first introduction hole and/or the second introduction hole is/are communicated with the mixing chamber, and the purified water is switched on as the guiding groove is communicated with a fluid through-hole. In the valve cartridge, there are separate flow paths for the tap-water and the purified water so as to avoid cross contamination, thereby ensuring that the purified water meets the drinking water standard all the time.

Figure 10:
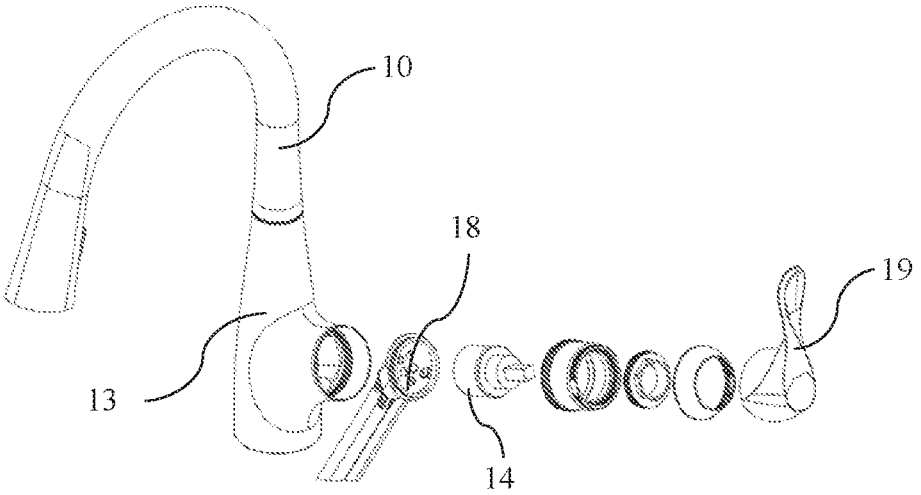
FIG. 10 is a partial exploded schematic view of the extractable faucet according to an embodiment of the disclosure.

Specifically, the extractable faucet 1 can further include a handle 19 for facilitating the control of the valve cartridge, with reference to the FIG. 10, the handle 19 is engaged to the valve stem of the valve cartridge 14. The valve stem which controls the switching on-off of the valve cartridge is implemented by adjusting the handle 19, in particular, by adjusting the movement range and angle of the handle 19 (the valve stem is associatively driven) to change the cooperation manner between the valve stem and the valve cartridge 14 (such as any of the flow paths are switched-on and any of the flow paths are switched-off), and then concludes the control to the tap-water and the purified water. Because the extractable faucet 1 is incorporated with the purified water pipe 112, two cooperation manners are employed for the valve cartridge 14 and the valve stem in this embodiment to control the switching on-off of the tap-water and the purified water. In particular, the handle connected to the valve stem may be rotated towards two sides from unopened state, and then lifted and moved at any one of both sides, after that, the areas at the two sides of the handle 19 located in the unopened state are divided into a tap-water control area and a purified water control area. In the tap-water control area, the handle 19 is lifted and moved around the axis of the mounting seat, and then the valve stem can be associatively driven (i.e. the valve stem is deviated from the axis of the valve cartridge 14 at an certain angle, the angle can be adjusted in accordance with actual application), and the valve stem is rotated by the lifted and moved handle 19 located in the tap-water control area to achieve supplying the hot water, cold water and mixing water, and the extent of motion and raise for the handle (valve stem which is controlled by the handle) can be controlled to adjust the flow of supplied fluid, depending on user's actual requirement. However, even if the handle has been rotated to the tap-water control area, it is also unable to implement the tap-water supply in case that the handle is located in the non-lifted state. When the valve stem is rotated to the purified water control area, the valve stem can be translated merely in a plane to control the switching on-off of the purified water and is incapable to be lifted, —namely, the valve stem can be used to switch on the purified water only in case that the tap-water is in the switching-off state (the handle is in the non-lifted state), thus avoid mistakenly switching-on the purified water and wasting purified water in daily use of water, while such a control manner implements a separate control of the purified water and the tap-water, and avoid polluting the purified water. As the valve stem is rotated to the purified water supply area, a constant amount of purified water can be supplied by the control of the valve stem to the valve cartridge 14 for the reason of a low requirement to the usage amount of purified water. Inlet hole(s) of purified water is provided on the valve cartridge 14 in its radial direction, whereas outlet hole(s) of the purified water and inlet hole(s) of cold water, hot water for the tap water and outlets hole(s) of the mixing water for tap-water are provided on an end surface of the valve cartridge, and the end surface is oriented to the base member 180, at the same time, the above-mentioned fluid supply holes correspond to holes on the base member 180 in order to achieve the purpose of supply and use of the purified water and tap-water.

Furthermore, other configurations of the valve cartridge can be also employed except for the above-mentioned valve cartridge for the switching-on and the switching-off of the purified water and the tap-water of the extractable faucet, respectively. In another embodiment of this disclosure, such a valve cartridge as provided can include a valve housing, a valve handle, a movable valve plate and a fixing valve plate. Wherein, the movable valve plate is located above the fixing valve plate and can be driven to rotate by the valve handle. The valve housing has a cold water inlet, a hot water inlet, a mixing water outlet, a purified water inlet and a purified water outlet. Through-hole(s) is provided on the fixing valve plate for communicating with fluid communication hole(s) of the valve housing, and a separate mixing chamber for the tap-water and a separate purified water chamber are provided on the underside of the movable valve plate, the mixing chamber of tap-water is communicated with the through-hole(s) connected to the mixed water. When the valve plate is located at the initial position, the valve cartridge with the above-mentioned structure can block the communication of the through-hole connecting to the cold water inlet and the through-hole connecting to the hot water inlet with the mixing chamber of the tap-water, and block the communication of the purified water chamber with the through-hole connecting to purified water inlet and the through-hole connecting to purified water outlet. When the movable valve plate is rotated clockwise from initial position, the tap-water mixing chamber is communicated with the through-hole(s) connecting to hot water inlet and/or that connecting to cold water inlet, while the purified water chamber is still in the blocked state with respect to the through-hole(s) connected respectively to the purified water inlet and the purified water outlet. However, when the movable valve plate is rotated anti-clockwise from the initial position, the tap water mixing chamber is still in the blocked state with respect to the through-hole(s) respectively connected to the hot water inlet and the cold water inlet, while the purified water chamber is in a communication state with respect to the through-hole(s) connected respectively to the purified water inlet and the purified water outlet. Utilizing this valve cartridge, user may achieve an operation experience which is different from that of the aforesaid valve cartridge, for example, there is no need to lift and then rotate the handle to control the switching on-off of the tap-water, thus facilitating simple operation for user. Certainly, it is understood by the skilled in the art that it is allowed to make suitable changes to the mounting seat accommodating the valve cartridge and the associated structure in case that different valve cartridges are utilized, so that components are mated with each other to meet the usage requirement.

Figure 2:
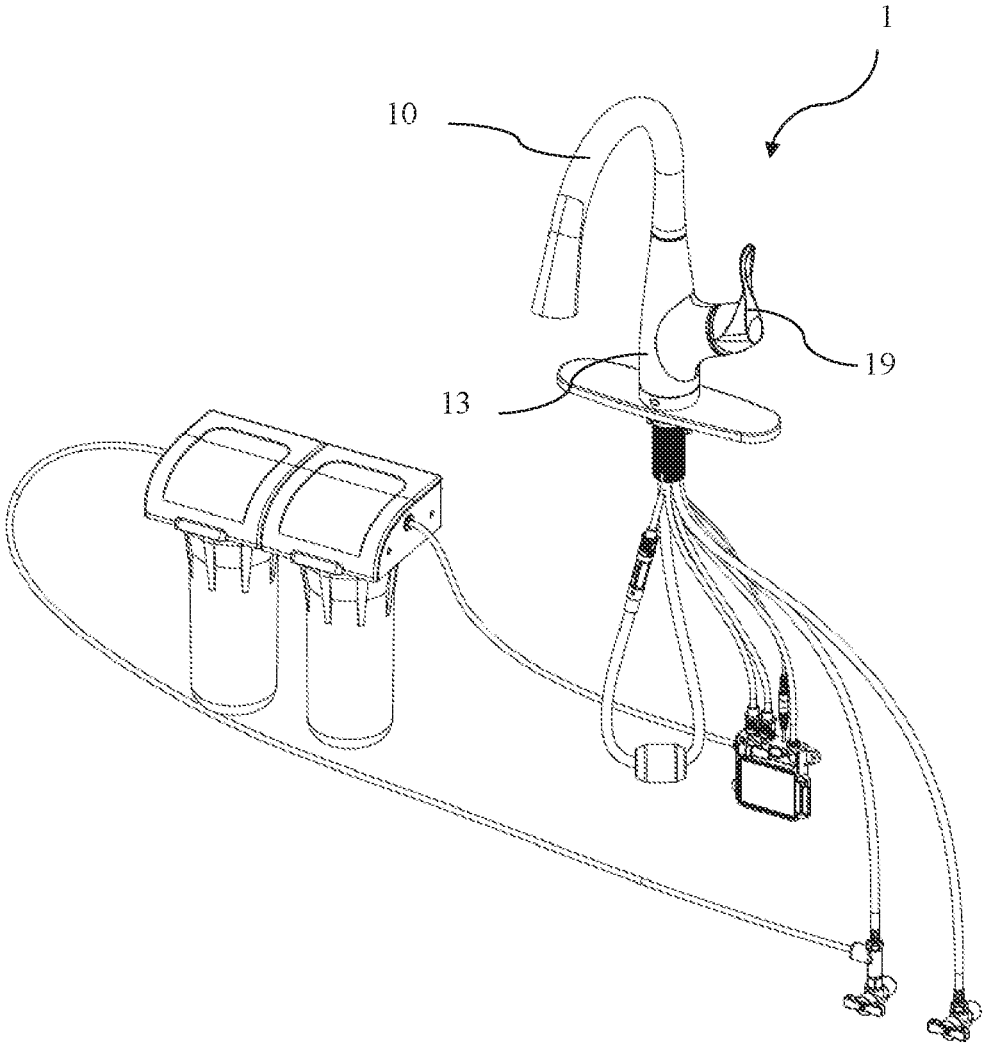
FIG. 2 is another perspective view of the extractable faucet according to an embodiment of the disclosure.

Referring to the FIGS. 1 to 2, in the aforesaid extractable faucet, a control valve is provided on a purified water end of the cold water pipe, the control valve is also communicated to the other introduction pipe which is used for introducing the cold water (tap-water) into a water purifier, and then the cold water is purified by the water purifier to obtain purified water, the purified water is conducted to controller before it is communicated with the valve cartridge 14. A flow line of the purified water in the form of multiple returns is connected to the controller so that the purified water pipe 112 may not exert an influence over the reset of the extractable conduit 111 when the extractable head 110 is reset and extracted. By means of the control of the valve cartridge 14, the flow path is switched on, and then the purified water is conducted to the inlet tube, subsequently to the outlet tube and finally to user. Under the worktop, weight(s) can be provided on a pipeline connecting to the extractable conduit to facilitate the reset of the extractable conduit. The cold water, the hot water and the mixing water (the mix of cold water and hot water) from cold water pipe and/or hot water pipe are conducted to the mixing water pipe, and then through the extractable conduit 111 which is connected to the mixing water pipe, and finally to user, thus implementing the usage of tap-water. This process is completed through the control of the valve cartridge. For the convenience for a user to confirm that the water being used is purified water or not, the extractable faucet also has indicator lamp(s) (may be LED indicator) provided on the mounting seat 13. In one embodiment, when the indicator lamp is lighted up, it may remind to the user that the purified water is being used, however, when the indicator lamp goes off, it may remind the user that the purified water is not used. To facilitate the multiple returns of the flow lines for the purified water under the worktop, the extractable faucet can also be configured with a controller box, which is used for supplying purified water to the purified water pipe 112 via the multiple return lines which are connected to the controller box and derived from the valve cartridge. The controller box can include a box, a first flow channel and a second flow channel. Wherein, a power supply (such as a battery) and a control board (such as a circuit board) are received in the box, the box is operated with the help of the power supply and the control board can deal with signals from the switching on-off of the purified water. The first flow channel is disposed within the controller box along the extension direction of the water flow path, and a detector is disposed in the first flow channel. The detector is configured to detect the switching on-off of the purified water in real time and to be forced to move towards a deeper point of the first flow channel when the purified water is conducted, and subsequently no more subjected to any forces and reset to the original position after the purified water is switched-off. The movement distance of the detector is fed back to the controller board, and then the controller board records the duration time for the purified water which is switched on depending the movement distance. The detector is preferably configured to be a water flow detector having a frame portion and a helical blade portion, the fluid exerts a force to the helical blade to facilitate the rotation of the water flow detector. Because the water flow detector is made of magnetic materials, the rotation of the water flow detector may pass through magnetic induction lines generated by the coils on the controller board, so that electric signals are generated and delivered to the controller board. Moreover, the detector may also be configured as a water flow check valve, comprising a valve shell, a valve plug, an elastic piece and a magnetic piece. The valve shell is configured to be a hollow column-shape piece and has windows on its circumferential surface. The valve cartridge is configured to be a plunger-shape and includes a rod portion and a plug portion, the elastic member (it is a spring in this embodiment) is located in the plug portion and sleeved on the rod portion, and a stop portion is disposed at the front of the rod portion and abuts against the front of the valve shell. In a usage of purified water state, the water flow check valve is pushed by the force generated by the fluid so that the valve cartridge may compress the spring to expose the windows of the valve shell, and further the fluid flows through the windows on the valve cartridge and flows to downstream of the valve shell, thus completing the switching-on of the purified water. At the moment, the magnetic member starts to displace and interacts with the controller board so that the controller board can receive the feedback signals of the purified water. The controller board can record the duration time of purified water which flows through the first flow channel to determine when to replace a filter core on basis of the flow duration time of the purified water.

The extractable faucet disclosed by the disclosure incorporates the purified water line into the extractable faucet and is controlled by a same valve cartridge for the switching on and the switching off of the purified water and tap-water, which satisfies the use convenience requirement of user for the direct drinking water, while reducing the occupied area in the kitchen and improving user-experience.

Although the disclosure is described through limited quantities embodiments, it is understood that the disclosure is not limited by such disclosed embodiments. Rather, any changes, modifications, replacements or equal devices which are not described previously are incorporated to revise the disclosure, however, which are equivalent to the spirit and scope of the disclosure. Furthermore, while various embodiments of the disclosure have been described, it is understood that the aspect of the disclosure can merely include some of the embodiments. Therefore, the disclosure is not regarded to be limited by the aforesaid description, however it is only limited by the appended claims.

LIST OF REFERENCE NUMERALS

1—extractable faucet
10—faucet housing
11—faucet body
110—extractable head
111—extractable conduit
112—purified water pipe
12—first support
13—mounting seat
14—valve cartridge
15—second support
150—base part
151—transition part
152—holding part
153—first holding portion
154—second holding portion
16—rotation detent part
17—wear-resistant structure
170—wear sleeve
172—wear washer
18—tube assembly
180—base member
181—first set of pipe fitting
182—second set of pipe fitting
19—handle

The invention claimed is:

1. A faucet, comprising:

a faucet housing configured as a tubular member with a cavity;

a faucet body comprising a head and a conduit, wherein a water inlet end of the head is connected to the conduit;

a first support received in the cavity and located at a water outlet end of the faucet housing, wherein the head is received in the first support, a purified water pipe is embedded detachably into the first support, and wherein the purified water pipe and the conduit run along the length of the faucet housing;

a mounting seat configured to function as a water distributor and detachably engaged with the faucet housing;

a valve cartridge received in the mounting seat, the valve cartridge configured to control a shut off of the conduit and the purified water pipe, and the valve cartridge separating a flow path of tap-water through the conduit and a flow path of purified water; and a second support secured into the cavity, wherein the second support comprises a base part, a holding part, and a transition part, wherein the base part is configured in the form of a cylinder, the transition part extends from the base part towards the water outlet end of the faucet housing and bends to conform to a curvature of the faucet housing, the holding part is disposed on the transition part and spaced apart from the base part, and the conduit and the purified water pipe are provided within the second support and separated by the holding part.

2. The faucet according to claim 1, wherein the holding part comprises a first holding portion and a second holding portion, the second holding portion is located in a space delimited by the first holding portion and connected to the first holding portion on a circumferential surface of the second holding portion, and wherein the conduit is disposed in the first holding portion and the purified water pipe is disposed in the second holding portion.

3. The faucet according to claim 1, wherein the second support is disposed within the cavity of the faucet housing, and an engagement portion is provided on an outer circumferential surface of the base part, and the faucet housing is provided with an engagement hole in a radial direction of the faucet housing, and wherein the second support is secured to the cavity by the engagement between the engagement portion and the engagement hole.

4. The faucet according to claim 1, wherein the faucet housing is rotatable with respect to the mounting seat, and the second support is moved together with the faucet housing.

5. The faucet according to claim 1, further comprising a rotation detent part, wherein the rotation detent part comprises a guide slot and a protrusion mated with each other, wherein the guide slot and the protrusion are disposed at an engagement region where the faucet housing is engaged to the mounting seat, wherein the guide slot allows the protrusion to slide and is configured to have a sector rotation region, and wherein the faucet housing is configured to rotate at most 180° with respect to the mounting seat with the protrusion rotating in the sector rotation region.

6. The faucet according to claim 5, further comprising a wear-resistant structure disposed in a region of the engagement where the faucet housing is engaged with the mounting seat.

7. The faucet according to claim 6, wherein the wear resistant structure comprise a wear sleeve and a wear washer, the wear sleeve is sleeved on one end of the faucet housing which is oriented towards the mounting seat, the wear sleeve comprises a locating portion, the mounting seat is provided with a locating hole on a surface of the mounting seat, the locating portion is configured to be engaged to the locating hole to locate the wear sleeve, and the wear washer is provided on the faucet housing and located between the faucet housing and the mounting seat in an axial direction.

8. The faucet according to claim 7, wherein the faucet further comprises a tube assembly which is received in an opening of the mounting seat and operated with the valve cartridge, the tube assembly comprises a base member, a first set of pipe fittings for the tap-water and a second set of pipe fittings for purified water, and wherein the first set of pipe fittings comprises a cold water pipe, a hot water pipe and a mixing water pipe, the second set of pipe fittings comprises an inlet tube and an outlet tube, and the first set of pipe fittings and the second set of pipe fittings are secured on the base member.

9. The faucet according to the claim 7, wherein the wear-resistant sleeve is configured as a bellows-shape piece with an opening, and the locating portion is configured to be engaged to the locating hole of the mounting seat.

* * * * *